US010403486B2

(12) United States Patent
Scott et al.

(10) Patent No.: US 10,403,486 B2
(45) Date of Patent: Sep. 3, 2019

(54) MASS SPECTROMETER DATA ACQUISITION

(71) Applicant: Micromass UK Limited, Wilmslow (GB)

(72) Inventors: Garry Michael Scott, Wigan (GB); David Darrell Williams, Wilmslow (GB); Peter Gerard Spreadbury, Liverpool (GB); Martin Raymond Green, Bowdon (GB); Anthony James Gilbert, High Peak (GB); Keith George Richardson, Derbyshire (GB); Jason Lee Wildgoose, Stockport (GB)

(73) Assignee: MICROMASS UK LIMITED, Wilmslow (GB)

( * ) Notice: Subject to any disclaimer, the term of this patent is extended or adjusted under 35 U.S.C. 154(b) by 35 days.

(21) Appl. No.: 15/240,304

(22) Filed: Aug. 18, 2016

(65) Prior Publication Data

US 2017/0053786 A1 Feb. 23, 2017

(30) Foreign Application Priority Data

Aug. 18, 2015 (GB) ..... 1514643.4

(51) Int. Cl.
*H01J 49/00* (2006.01)
*H01J 49/40* (2006.01)

(52) U.S. Cl.
CPC ..... *H01J 49/0036* (2013.01); *H01J 49/40* (2013.01)

(58) Field of Classification Search
None
See application file for complete search history.

(56) References Cited

U.S. PATENT DOCUMENTS

| | | | | |
|---|---|---|---|---|
| 6,229,142 | B1 * | 5/2001 | Bateman | H01J 49/0036 250/287 |
| 7,518,108 | B2 * | 4/2009 | Frey | H01J 49/0045 250/281 |
| 8,063,358 | B2 | 11/2011 | Bateman et al. | |
| 8,080,782 | B2 | 12/2011 | Hidalgo et al. | |
| 8,658,971 | B2 * | 2/2014 | Green | G06K 9/0053 250/287 |
| 8,729,462 | B2 * | 5/2014 | Gilbert | H01J 49/022 250/282 |
| 8,809,767 | B2 | 8/2014 | Bateman et al. | |
| 9,881,781 | B2 * | 1/2018 | Green | H01J 49/0031 |
| 2005/0061968 | A1 * | 3/2005 | Green | H01J 43/246 250/288 |
| 2009/0321628 | A1 | 12/2009 | Bateman et al. | |
| 2010/0213361 | A1 * | 8/2010 | Green | H01J 49/0036 250/252.1 |

* cited by examiner

*Primary Examiner* — David M. Gray
*Assistant Examiner* — Geoffrey T Evans

(57) ABSTRACT

A data acquisition system for a TOF mass spectrometer comprises a processing module and a data collection module. The processing module generates a stream of data comprising, for each respective transient of a first scan, a set of time-intensity related parameter pairs. For each new set of data, the data collection module reads out a previous set of data from a previous memory bank, merges that previous set of data with the new set of data, and writes that latest merged set of data into a memory bank other than the previous memory bank. The data acquisition system provides a convenient way to merge sequential sets of time-intensity related parameter pairs for respective transients as a stream of data for a first scan is generated.

13 Claims, 10 Drawing Sheets

Instrument computing network
Data processing & instrument control
11
Optional high performance computing network
12
1
Data acquisition system
Instrument control module
10
High bandwidth data path
Data collection module
9
Initial (front end) processing module
8
ADC
6
ADC
7
Trigger processing module
4
High
Dual gain amplification
Low
5
High voltage pulser
3
Ion detector
2

Fig. 4

| TIME SLOT | INPUT FIFO | BANK 0 ADDR | BANK 1 DATA | BANK 1 ADDR | BANK 0 DATA | Notes |
|---|---|---|---|---|---|---|
| 0 | S1T0 | 0 | EMPTY | 0 | | |
| 1 | S1T5 | | | | S1T0 | |
| 2 | S1T10 | | | 1 | S1T5 | |
| 3 | S1T16 | | | 2 | S1T10 | |
| 4 | S1T25 | | | 3 | S1T16 | |
| 5 | S2T0 | | | 4 | S1T25 | Turnaround |
| 6 | S2T0 | | | 0 | S1T0 | |
| 7 | S2T9 | 0 | S2T0+S1T0 | 1 | S1T5 | |
| 8 | S2T9 | 1 | S1T5 | 2 | S1T10 | |
| 9 | S2T10 | 2 | S2T9 | | | |
| 10 | S2T15 | 3 | S2T10+S1T10 | 3 | S1T16 | |
| 11 | S2T17 | 4 | S2T15 | | | |
| 12 | S2T17 | 5 | S1T16 | 4 | S1T25 | |
| 13 | S2T22 | 6 | S2T17 | | | |
| 14 | S3T0 | 7 | S2T22 | | | |
| 15 | S3T0 | 8 | S1T25 | | | Turnaround |
| 16 | S3T0 | 0 | S2T0+S1T0 | 0 | | |
| 17 | S3T3 | 1 | S1T5 | | S3T0+S2T0+S1T0 | |
| 18 | S3T9 | | | 1 | S3T3 | |
| 19 | S3T9 | 2 | S2T9 | 2 | S1T5 | |
| 20 | S3T13 | 3 | S2T10+S1T10 | 3 | S3T9+S2T9 | |
| 21 | S3T13 | 4 | S2T15 | 4 | S2T10+S1T10 | |
| 22 | S3T20 | | | 5 | S3T13 | |
| 23 | S3T20 | 5 | S2T16 | 6 | S2T15 | |
| 24 | S3T20 | 6 | S2T17 | 7 | S1T16 | |
| 25 | S3T20 | 7 | S2T22 | 8 | S2T17 | |
| 26 | S3T29 | | | 9 | S3T20 | |
| 27 | S3T29 | 8 | S1T25 | 10 | S2T22 | |
| 28 | S3T29 | | | 11 | S1T25 | |
| 29 | S4T0 | | | 12 | S3T29 | Turnaround |
| 30 | S4T0 | | | 0 | S3T0+S2T0+S1T0 | |
| 31 | S4T… | 0 | S4T0+S3T0+… | 1 | S3T3 | … |

MASS SPECTROMETER DATA ACQUISITION

CROSS-REFERENCE TO RELATED APPLICATION

This application claims priority from and the benefit of United Kingdom patent application No. 1514643.4 filed on 18 Aug. 2015. The entire contents of this application are incorporated herein by reference.

FIELD OF THE INVENTION

The present invention relates generally to mass spectrometers and in particular to data acquisition for Time of Flight mass spectrometers.

BACKGROUND

It is known to use Time to Digital Converters ("TDC") and Analogue to Digital Converters ("ADC") as part of data recording electronics for many analytical instruments including Time of Flight ("TOF") mass spectrometers.

Time of Flight instruments incorporating Time to Digital Converters are known wherein signals resulting from ions arriving at an ion detector are recorded. Signals which satisfy defined detection criteria are recorded as a single binary value and are associated with a particular arrival time relative to a trigger event. A fixed amplitude threshold may be used to trigger recording of an ion arrival event. Ion arrival events which are subsequently recorded resulting from subsequent trigger events are combined to form a histogram of ion arrival events. The histogram of ion arrival events is then presented as a spectrum for further processing. One disadvantage of TDCs is that once an ion arrival event has been recorded then there is a significant time interval or dead-time following the ion arrival event during which time no further ion arrival events can be recorded. Another important disadvantage of TDCs is that they are unable to distinguish between a signal resulting from the arrival of a single ion at the ion detector and a signal resulting from the simultaneous arrival of multiple ions at the ion detector. This is due to the fact that the signal will only cross the threshold once, irrespective of whether a single ion arrived at the ion detector or whether multiple ions arrived simultaneously at the ion detector. Both situations will result in only a single ion arrival event being recorded. These effects have the result of limiting the dynamic range of the ion detector system.

In Time of Flight instruments which incorporate ADCs, an ADC is arranged to digitise signals resulting from ions arriving at an ion detector relative to a trigger event. The digitised signals resulting from subsequent trigger events are summed or averaged to produce a spectrum for further processing. One advantage of using an ADC as part of an ion detector system is that multiple ions which arrive substantially simultaneously at an ion detector and at relatively higher signal intensities can be recorded without the ion detector suffering from distortion or saturation effects.

Typically, an ADC based system measures the time of flight transient "start" events i.e. the time at which ions are accelerated into the flight tube of the Time of Flight analyser. A detector, ADC and associated processing hardware are capable of reducing the detector signal for each time of flight transient to "stop" events i.e. a series of time and intensity pairs representing the arrival of a single ion or the simultaneous arrival of a plurality of ions at the detector subsequent to a start event. This series is naturally ordered in time.

The time and intensity pairs may be organised in a histogram with results being put into a series of windows along a time axis. The histogramming algorithm typically used needs to perform Read Modify Write ("RMW") cycles on memory in which data is stored, each time that a new event arrives. Synchronous dynamic random access memory ("SDRAM") often requires tens of clock cycles to achieve a single access. These clock cycles are further extended when doing a bus turnaround i.e. switching between a read and a write. The result is that using a conventional histogramming algorithm limits the achievable performance for SDRAM.

US 2011/0024620 (Hidalgo) describes a method of accumulating ion intensities in Time of Flight (TOF) bins. In the method described in Hidalgo, data structures that each relate to an ion detection event are generated, wherein the ion detection event can relate to plural temporally-irregular and interfering transients. The method described in Hidalgo is intended to resolve the data for these interfering transients.

It is desired to provide an improved method of data acquisition for a Time of Flight mass spectrometer.

SUMMARY

According to an aspect there is provided a method of data acquisition for a Time of Flight mass spectrometer comprising:

receiving, by a data acquisition system, data from an ion detector of a mass spectrometer, the data acquisition system including a processing module and a data collection module;

during a first scan, generating, by the processing module, a stream of data containing a plurality of sets of data, each set of data including a plurality of data pairs of: (i) a time of flight related parameter; and (ii) an intensity related parameter, in respect of a respective transient; and passing the stream of data from the processing module to the data collection module;

wherein:

the data collection module includes a plurality of memory banks;

a first data set of the stream of data is written into a first memory bank of the plurality of memory banks;

after completion of writing the first data set into the first memory bank, the data in the first memory bank is read out and merged with the data of a second data set of the stream of data to create a merged data set and wherein the merged data set is written into a second memory bank of the plurality of memory banks;

after completion of writing the merged data set into the second memory bank, the data in the second memory bank is read out and merged with the data of a third data set of the stream of data to create a latest merged data set and wherein the latest merged data set is written into a memory bank of the plurality of memory banks, other than the second memory bank;

optionally, for each subsequent set of data in the stream of data in the first scan, the currently latest merged data set is read out from the memory bank of the plurality of memory banks which contains that currently latest merged data set, that currently latest merged data set is merged with the subsequent set of data in the stream of data to create a new latest merged data set, and the new latest merged data set is written into a memory bank of the plurality of memory banks other than that from which the previous latest merged data set was read; and at the end of the first scan, the data in the memory bank containing the latest merged data set is read out and a merged data stream containing that latest merged data set is outputted from the data collection module; wherein there is a predetermined series of consecutive intervals to contain time of flight related parameter values; and in merging the data from a memory bank with a data set in the stream of data to create a merged data set, if a data pair in the data from the memory bank has a time of flight related parameter value within the same interval in the predetermined series as a time of flight related parameter value of a data pair in the data set in the stream of data, a single data pair is created in the merged data set.

Embodiments described herein accordingly comprise, for each new set of data generated by a processing module, a data collection module reading out a previous set of data from a previous memory bank, merging (e.g. histogramming) that previous set of data with the new set of data, and writing that latest merged set of data into a memory bank other than the previous memory bank. Embodiments described herein accordingly provide a convenient way to merge sequential sets of data for respective transients as a stream of data for a scan is generated.

As discussed above, US 2011/0024620 (Hidalgo) describes a method of accumulating ion intensities in TOF bins. However, Hidalgo does not disclose generating a stream of data comprising a set of time-intensity pairs for each respective transient as per embodiments described herein. Instead, as discussed above, Hidalgo discloses generating data structures that each relate to a detection event, wherein the detection event can relate to plural interfering transients. This is because the aim of the method described in Hidalgo is to have temporally-irregular transients that are close together in time, so as to increase productivity, but then to try to resolve the resultant interfering transients. Furthermore, Hidalgo does not disclose a method in which, during the same scan, a set of data is read out of a first memory bank, merged with a next set of data, and written to a second different memory bank as per embodiments described herein. It is clear, therefore, that Hidalgo is not relevant to embodiments described herein.

According to an embodiment where data in a memory bank is read out and merged with data in a data set in the stream of data, the data in the memory bank is read out and histogrammed with the data in the data set in the stream of data.

According to an embodiment where data in a memory bank is read out and merged with data in a data set in the stream of data, if a data pair in the data from the memory bank has a time of flight related parameter value within the same interval in the predetermined series as a time of flight related parameter value of a data pair in the data set in the stream of data, the single data pair which is created in the merged data set has an intensity value which is equal to the sum of: (i) the intensity value of the data pair in the data from the memory bank; and (ii) the intensity value of the data pair in the data set in the stream of data.

According to an embodiment where data in a memory bank is read out and merged with data in a data set in the stream of data, if a data pair in the data from the memory bank has a time of flight related parameter value within the same interval in the predetermined series as a time of flight related parameter value of a data pair in the data set in the stream of data, the single data pair which is created in the merged data set has a time of flight related parameter value which is equal to the average of: (i) the time of flight related parameter value of the data pair in the data from the memory bank; and (ii) the time of flight related parameter value of the data pair in the data set in the stream of data.

According to an embodiment the average of the time of flight related parameter values is a weighted average.

According to an embodiment the plurality of memory banks consists of two memory banks which alternate between being in read mode and write mode so that when one data bank is in write mode and data is being written into that data bank, the other data bank is in read mode and data is being read from that other data bank.

According to an embodiment the plurality of memory banks includes three memory banks, and at any given time whilst the stream of data is being received during the first scan, a merge operation is carried out using two of the memory banks and the stream of data so that one of the two memory banks is in read mode and data is read out of that one memory bank and merged with a data set from the stream of data to create a merged data set and the other of the two memory banks is in write mode and the merged data set is written into that other memory bank and when at the end of the first scan the latest merged data is read out of one of the two memory banks, the remaining two of the three memory banks and the stream of data are used in a merge operation during a second scan.

According to an embodiment each set of data and each merged data set includes metadata associated with the time of flight related parameter and intensity related parameter pairs.

According to an embodiment data in the sets of data in the data stream, and data in each merged data set, is ordered in time.

According to an embodiment the intervals and/or time values are mapped to memory addresses.

According to an embodiment the processing module supplies respective streams of data, to a plurality of the collection modules, and respective output streams from the plurality of collection modules are combined.

According to an embodiment in the predetermined series of consecutive intervals to contain time of flight related parameter values, the intervals are not equal.

According to an embodiment there is a first segment of intervals each of which extends over a first, relatively narrower, band of values and a second set of intervals each of which extends over a second, relatively wider, band of values.

According to an embodiment the first segment of intervals is for values of time of flight parameter values corresponding to masses or mass to charge ratios below a predetermined limit and the second segment of intervals is for values of time of flight parameter values corresponding to masses or mass to charge ratios at or above the predetermined limit.

According to an embodiment acquired data is analysed during a scan by way of passing data to a data gate at the same time as it is being written to a memory bank, e.g. so that decisions can be taken as to whether to change any instrument settings.

According to an embodiment data is passed to the data gate at a predetermined frequency of writes to the memory bank.

According to an embodiment the data passed to the data gate is a curtailed set of the data written to the memory bank.

According to an embodiment the stream of data contains a plurality of consecutive sets of data. The second data set may be consecutive to the first data set. The third data set may be consecutive to the second data set. Each subsequent set of data in the stream of data may be a subsequent consecutive set of data in the stream of data.

According to another aspect there is provided a method of mass spectrometry comprising a method of data acquisition for a Time of Flight mass spectrometer as described herein.

According to another aspect there is provided a data acquisition system for a Time of Flight mass spectrometer comprising:

a device arranged and adapted to receive data from an ion detector of a mass spectrometer;

a processing module; and a data collection module comprising a plurality of memory banks;

wherein during a first scan the processing module is arranged and adapted:

(i) to generate a stream of data containing a plurality of sets of data, each set of data including a plurality of data pairs of: (a) a time of flight related parameter; and (b) an intensity related parameter, in respect of a respective transient; and (ii) to pass the stream of data from the processing module to the data collection module;

wherein a first data set of the stream of data is written into a first memory bank of the plurality of memory bands;

wherein after completion of writing the first data set into the first memory bank, the data in the first memory bank is read out and merged with the data of a second data set of the stream of data to create a merged data set and wherein the merged data set is written into a second memory bank of the plurality of memory banks;

wherein after completion of writing the merged data set into the second memory bank, the data in the second memory bank is read out and merged with the data of a third data set of the stream of data to create a latest merged data set and the latest merged data set is written into a memory bank of the plurality of memory banks, other than the second memory bank;

wherein optionally for each subsequent set of data in the stream of data in the first scan, the current latest merged data set is read out from the memory bank of the plurality of memory banks which contains that current latest merged data set, that current latest merged data set is merged with the set of data in the stream of data to create a new latest merged data set, and the new latest merged data set is written into a memory bank of the plurality of memory banks other than that from which the previous latest merged data set was read; and wherein at the end of the first scan, the data in the memory bank containing the latest merged data set is read out and a merged data stream containing that latest merged data set is outputted from the data collection module; wherein there is a predetermined series of consecutive intervals to contain time of flight related parameter values; and in merging the data from a memory bank with a data set in the stream of data to create a merged data set, if a data pair in the data from the memory bank has a time of flight related parameter value within the same interval in the predetermined series as a time of flight related parameter value of a data pair in the data set in the stream of data, a single data pair is created in the merged data set.

In some embodiments, where data in a memory bank is read out and merged with data in a data set in the stream of data, if a data pair in the data from the memory bank has a time of flight related parameter value within the same interval in said predetermined series as a time of flight related parameter value of a data pair in the data set in the stream of data, the single data pair which is created in the merged data set has an intensity value which is equal to the sum of: (i) the intensity value of the data pair in the data from the memory bank; and (ii) the intensity value of the data pair in the data set in the stream of data.

In some embodiments, if a data pair in the data from the memory bank has a time of flight related parameter value within the same interval in said predetermined series as a time of flight related parameter value of a data pair in the data set in the stream of data, the single data pair which is created in the merged data set has a time of flight related parameter value which is equal to the average of: (i) the time of flight related parameter value of the data pair in the data from the memory bank; and (ii) the time of flight related parameter value of the data pair in the data set in the stream of data. In some embodiments the average of the time of flight related parameter values is a weighted average.

In some embodiments, each set of data includes metadata associated with data pairs, for example including, but not limited to, any of the following, namely metadata indicating: (i) in ADC based systems, the saturation of the ADC; (ii) for Ion Mobility Separation (IMS) systems, the ion mobility time; (iii) for multi channel systems, the channel number; and (iv) statistical data such as the width, skew, kurtosis and/or maximum intensity.

The time of flight related parameter in a data pair may be the time of flight or a parameter derived from the time of flight such as the mass or mass to charge ratio. Accordingly, the data pairs may be time and intensity pairs or mass or mass to charge ratio and intensity pairs.

In embodiments the data pairs in the stream of data that is passed to the collection module are generated using an ADC or a plurality of ADCs of the data acquisition system. However, the various embodiments are also applicable to other systems such as those using a TDC or multi anode ion detector systems.

The processing module may operate in a number of modes, including scope mode, signal averager mode, peak detecting mode, classic TDC, peak detecting TDC or peak detecting averager, as long as the processing module can pass to the data collection module data comprising pairs of time of flight related parameters and associated parameters, such as time/intensity pairs or mass/intensity pairs or mass to charge ratio/intensity pairs.

In some embodiments the data output by the data collection module is in the form of a compressed spectrum or compressed spectra with increased dynamic range and/or increased accuracy in terms of time of flight related parameters which are indicative of mass or mass to charge ratio. In various embodiments, there is an improved input event rate over known histogramming or signal averager techniques. This may lead to increased instrument sensitivity over greater time of flight or mass or mass to charge ratio ranges and/or longer ion mobility separation drift times and/or faster system throughput.

In some embodiments, there may be two memory banks which are used in carrying out the method. The spectrum to be output can be built up by switching between the two banks. The banks switch between read and write, so that when one is being read the other is being written to. The banks may only switch over from write to read and the end of a set of data i.e. when a new transient is presented (namely when a new trigger event or an IMS synchronisation signal is detected). At the end of a scan the memory bank that was last written to may be read out. In using a two memory bank system the bank that was last written to may be read out completely before a new scan starts. During this period, data to be streamed to the data collection module may be buffered, for example in a First In First Out ("FIFO") buffer.

In some embodiments there are more than two memory banks which are used in carrying out the method of the various embodiments, and in some embodiments there are three memory banks. The advantage of the three memory bank architecture is that there can be two memory banks free to operate with the sets of data being streamed from the processing module. For example, if there are three memory banks B0, B1 and B2 and the last data bank written to is bank B1, then the merge operation can be carried out using banks B0 and B2 whilst bank B1 is read out.

The methods in accordance with the various embodiments may take advantage of the burst read and burst write performance of SDRAM and may also exploit the fact that input events from Time of Flight mass spectrometers are time ordered.

Data streaming may be performed with either list based architectures or memory mapped architectures. With memory mapped architectures, time bins or intervals may map to memory addresses, so time values do not have to be stored. This latter approach may be more efficient for densely populated spectra. RMW may be avoided by streaming marked regions of memory from one bank to another bank, whilst merging with the new input stream. The marked regions may indicate spectral usage. Alternatively, the whole contents may be streamed if the memory bandwidth is fast enough to transfer the whole spectrum between bus turnarounds.

Instead of mapping time values to memory there may be buffered a record (for example, a list of time ordered ion mobility spectrometry, time, intensity values) of individual events. Each event within a record may be stored in contiguous memory and no individual RMWs may be performed. Instead of individual RMWs occurring for every event, the method of the various embodiments may use two independent banks of memory (each with separate controllers) as record buffers. In embodiments, switching between reads and writes may occur only when the start of a new record set is received (e.g. a trigger or IMS sync). As records become longer the period between bus turnarounds may increase therefore increasing the data streaming efficiency.

At any one time, one memory controller may be writing streamed data and the other reading streamed data. The read stream may be merged with the new event stream from the front end (taking advantage of the inherent time ordering). In some embodiments, the merge process may be a highly pipelined process outputting new results on every clock cycle with either a fixed or elastic latency (e.g. with maximum ratio 1:2). The resulting merged data may also be time ordered and this may be streamed to the alternate memory with minimal latency between the reading of one bank and the simultaneous writing of the other. During the merging, if both ports contain the same IMS time value then the associated intensities may be summed causing a 2:1 event rate reduction for spectral peaks.

Memory addressing using event list pointers to each event in the record may result in incremental address sequences therefore minimising page misses, further increasing memory efficiency. As such, time coding may not be implicit in the memory address as with conventional histogramming. Instead, time codes may be stored alongside the accumulated intensity data, for example in SDRAM.

According to various embodiments there is streamed record accumulation i.e. a process of merging time ordered lists, minimising bus turnarounds.

Methods in accordance with the various embodiments may be carried out in parallel, in multiple instances, such as two. Alternate records from the processing module may be flipped to different instances. This may result in multiple, e.g. two, output streams which may be merged.

Streamed record accumulation as described above may provide an ordered list taking advantage of the improved transfer rate of readily available RAM in the cases of contiguously accessed data locations when compared with the case of randomly accessed data locations. A method of constructing a list of events which is ordered in real time may be provided. In embodiments which include metadata within an event record, intelligent manipulation of the data set may be possible, for example determining whether to use a higher or lower gain data channel based on an ADC saturation flag.

In some embodiments, in the predetermined series of consecutive intervals to contain time of flight related parameter values, the intervals are not equal. Thus, for example, there may be a first set of intervals each of which extends over a first, relatively narrower, band of values and a second set of intervals each of which extends over a second, relatively wider, band of values. Because each time of flight related parameter value may be allocated to an interval, or "bin", the intervals of the first set may provide a higher resolution than the intervals of the second set. There may thus be a segmented resolution grid, having the first set of intervals and then the second set of intervals. In some embodiments, there are three or more sets of intervals, providing for example a higher resolution segment of the grid, a medium resolution segment of the grid and a lower resolution segment of the grid, and such other segments as are desired.

It may be that the highest resolution segment of the grid is needed only for the lowest range of masses or mass to charge ratios of particles being detected. Thus, for example, the upper limit of the higher resolution segment may be equivalent to a mass limit of about 1500 amu (atomic mass units) and the upper limit of the medium resolution segment may be equivalent to a mass limit of about 10,000 amu (atomic mass units). The limits may for example be determined by the time of flight, with higher masses or mass to charge ratios being associated with higher times of flight. The number of segments, the change over points between segments, and the resolutions within segments may be programmable by software to account for different instruments and/or applications on the instrument. More segments (and segment boundary registers) may be added as required. Alternatively, a look-up table approach may be implemented where different mass or mass to charge ratio ranges can be set to different resolutions. The resolution does not necessarily have to step monotonically through the spectrum. This lookup table may be set by software for particular experiments. For example, there may be three mass or mass to charge ratio ranges of interest and a user may want to know roughly what is in the rest of the spectrum but is not concerned about higher resolution in these areas. Software could then program the three areas of interest to higher resolution and the other areas to lower resolution. The principle may be extended to also step the resolution for different IMS channels. This may considerably optimise input and output event rate performance as well as file size for the user.

Segmentation may be made completely transparent to software. Transparency is eased by the new architecture in accordance with the various embodiments. Memory addresses may no longer be used as time values but rather time (or $\Delta T$) may be stored alongside intensities in the list. The Time (or $\Delta T$'s) in the list can be kept at the chosen highest segment resolution for the system. The dynamic range for T may not change with the segments. All that may happen is that for the spectra occurring within the next lowest resolution segment, no odd time codes from the higher segment occur.

In embodiments with segmented resolution, the size of the integrated data set may be reduced by combining more events at higher masses or higher mass to charge ratios or longer flight times, where the width of the ion arrival envelope for ions of a given mass or mass to charge ratio value is higher. The reduced data set may be faster to process downstream and may have reduced storage requirements.

In some known systems it is known to have Data Directed Acquisition ("DDA") in which acquired data is analysed and decisions taken as whether to change any instrument settings. This is normally done after a scan has been completed and transmitted to an embedded computer.

A feature of various embodiments is that the whole data set may be traversed for every input set and the complete spectrum may be continuously passed through, for example, a field programmable gate array ("FPGA"). The FPGA may effectively see every point in the spectrum and whilst the FPGA has this data there may be no timing overhead by copying to one or more destinations at once. Thus, as well as writing data to the databanks in the method in accordance with the various embodiments, the data may be copied to an additional data storage location, ported to a processor or ported to a communications port. In some embodiments, therefore, as well as writing data to one of the said memory banks, the same data may be written to a DDA data gate. This DDA data gate may be pre-programmed with a DDA rule set. The following scenarios are possible, but are not exclusive: (i) sending the spectrum every N iterations, i.e. whilst the scan is building up since there is no need to wait until the end of the scan; the spectrum may be sent to a DDA memory or to a communications port such as PCIe or SpaceWire; the number N or iterations can be programmable; (ii) the DDA data gate may curtail the data sent (e.g. to DDA decision software) for example by curtailing the spectrum to certain time windows; (iii) the DDA data gate may just transmit (e.g. to DDA decision software) peaks that exceed certain amplitudes; and (iv) a combination of any of the above.

The DDA processor can make directed decisions during the same scan instead of waiting for the whole scan to be transferred and then re-analysed by software. The DDA processor may be an embedded soft core processor inside e.g. an FPGA, an external microprocessor or an embedded PC or COM express module (if this is the case curtailed data may be streamed by the data collection module directly into embedded computer memory over a suitable communications protocol such as PCIe).

Thus, data can be gated through programmable intensity and/or time (or mass or mass to charge ratio) hardware to allow low latency DDA decisions to be performed as early as possible in the scan integration time.

The seamless DDA approach and DDA gate may provide a snapshot of the spectrum after each time of flight transient or at intervals through the integration period. The snapshot may become more accurate later in the scan as more transients are integrated but it may be possible to make a DDA decision early in the integration time.

According to another aspect there is provided a Time of Flight mass spectrometer comprising a data acquisition system as described herein.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi) >about 500 V peak to peak.

The AC or RF voltage may have a frequency selected from the group consisting of: (i) <about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) >about 10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) <about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) >about 1000 mbar.

According to an embodiment analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions may comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2 dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to an embodiment the process of Electron Transfer Dissociation fragmentation comprises interacting analyte ions with reagent ions, wherein the reagent ions comprise dicyanobenzene, 4-nitrotoluene or azulene.

BRIEF DESCRIPTION OF THE DRAWINGS

Various embodiments will now be described, by way of example only, and with reference to the accompanying drawings in which:

FIG. 4 shows a table showing how records may be stored in memory;

DETAILED DESCRIPTION

Figure 1:
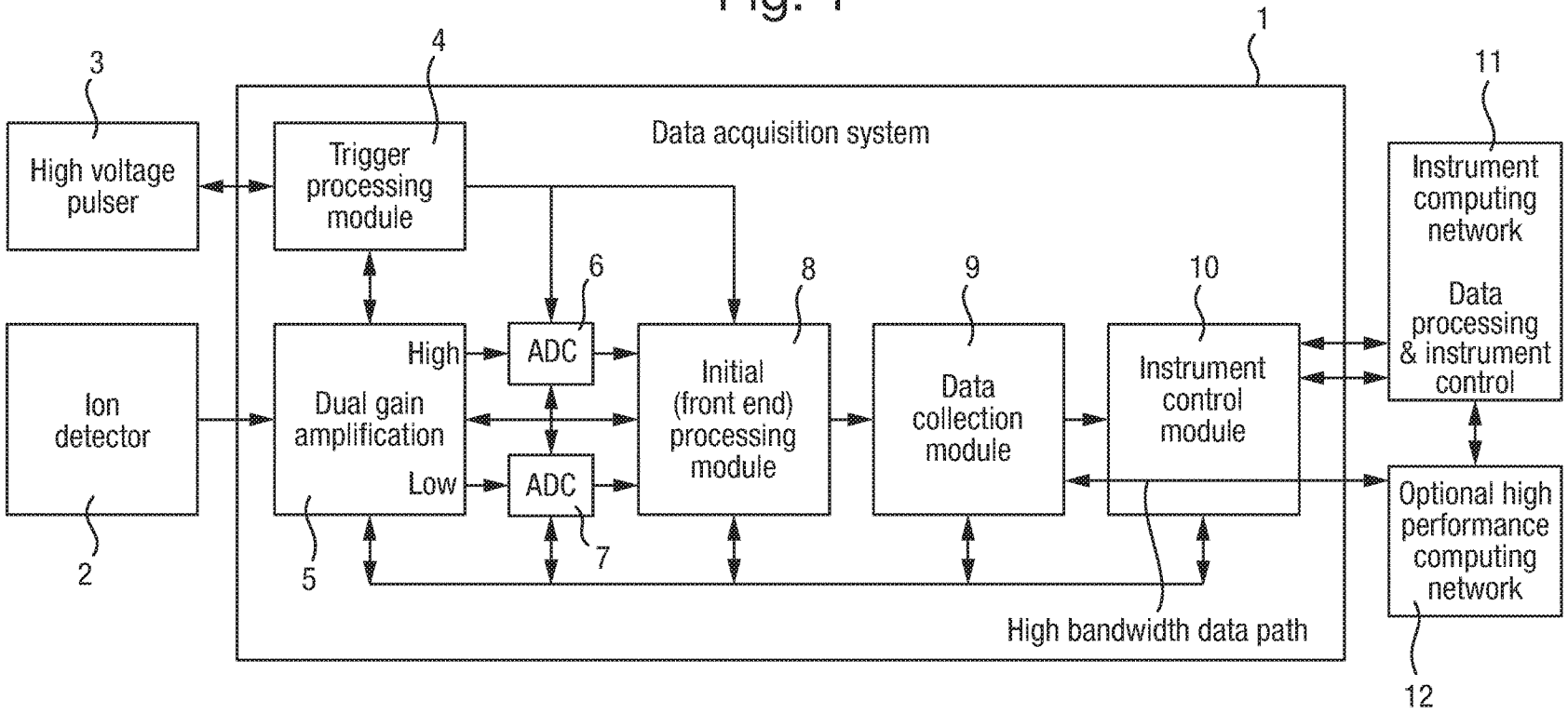
FIG. 1 shows a schematic view of one embodiment of a data acquisition system for carrying out a method in accordance with an embodiment.

An embodiment will now be described with reference to FIG. 1. FIG. 1 shows a data acquisition system 1 for a Time of Flight mass spectrometer including an ion detector 2 and a high voltage pulser 3. Within the data acquisition system 1 are a trigger processing module 4 and a dual gain amplifier 5. These are connected to a pair of ADCs 6 and 7 which feed data to an initial (front end) processing module 8. The processing module 8 comprises processing circuitry configured to generate and stream pairs of time and intensity data to a data collection module 9. The processing module 8 can operate in several modes, including scope mode, signal averager mode, peak detecting mode, classic TDC, peak detecting TDC or peak detecting averager. The processing module 8 operating mode may be controlled by an instrument control module 10 connected to an instrument computing network 11.

The data collection module 9 outputs compressed spectra with increased dynamic range and mass or mass to charge ratio accuracy to a computer over the instrument computing network 11 or an optional high performance computing network 12.

Conventional histogramming techniques using sparse, non-contiguous RMW (Read, Modify, Write) cycles to memory severely limits the achievable performance for SDRAM. In embodiments, a histogramming architecture is modified to take advantage of the burst read and burst write performance of SDRAM. The architecture also exploits the fact that input events from a Time of Flight mass spectrometer are time ordered.

Figure 2:
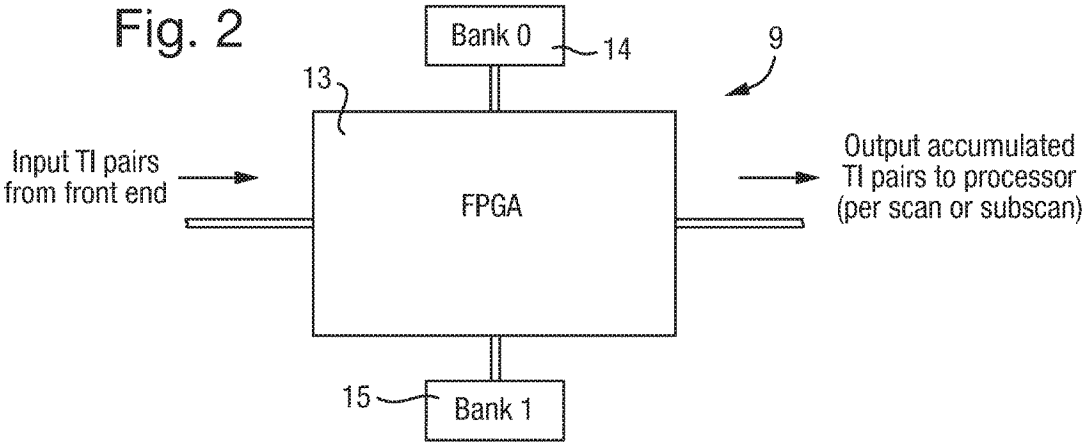
FIG. 2 shows a diagrammatic view of one embodiment of a data collection module used in the system of FIG. 1.

In some embodiments, instead of mapping time values to memory address, there is stored a record (a list of time ordered ion mobility, time, intensity values) of individual events. Each event within a record may be stored in contiguous memory and no individual RMWs will be performed. Instead of individual RMWs occurring for every event, this embodiment uses two independent banks of memory (each with separate controllers) as record buffers. FIG. 2 shows an embodiment of such an arrangement. The data collection module 9 comprises data collection circuitry configured to merge sets of data, in this embodiment in the form of a field programmable gate array 13, and two banks of memory, "bank 0" 14 and "bank 1" 15. Switching between reads and writes will occur only when the start of a new record set is received, such as a trigger or IMS sync. As records become longer the period between bus turnarounds will increase therefore increasing the data streaming efficiency.

At any one time, one memory controller will be writing streamed data and the other reading streamed data. The read stream may be merged with the new event stream from the front end (taking advantage of the inherent time ordering). The merge process may be a highly pipelined process, outputting new results on every clock cycle with either a fixed or elastic latency (max ratio 1:2). The resulting merged data will also be time ordered and this will be streamed to the other memory bank with minimal latency between the reading of one bank and the simultaneous writing of the other. During the merging, if both ports contain the same IMS time value then the associated intensities will be summed causing a 2:1 event rate reduction for spectral peaks.

Memory addressing using list based or memory mapped streaming architectures results in incremental address sequences therefore minimising page misses, further increasing memory efficiency. As such, time coding cannot be implicit in the memory address as with conventional histogramming. Instead, there are stored time codes alongside the accumulated intensity data in SDRAM.

Figure 3:
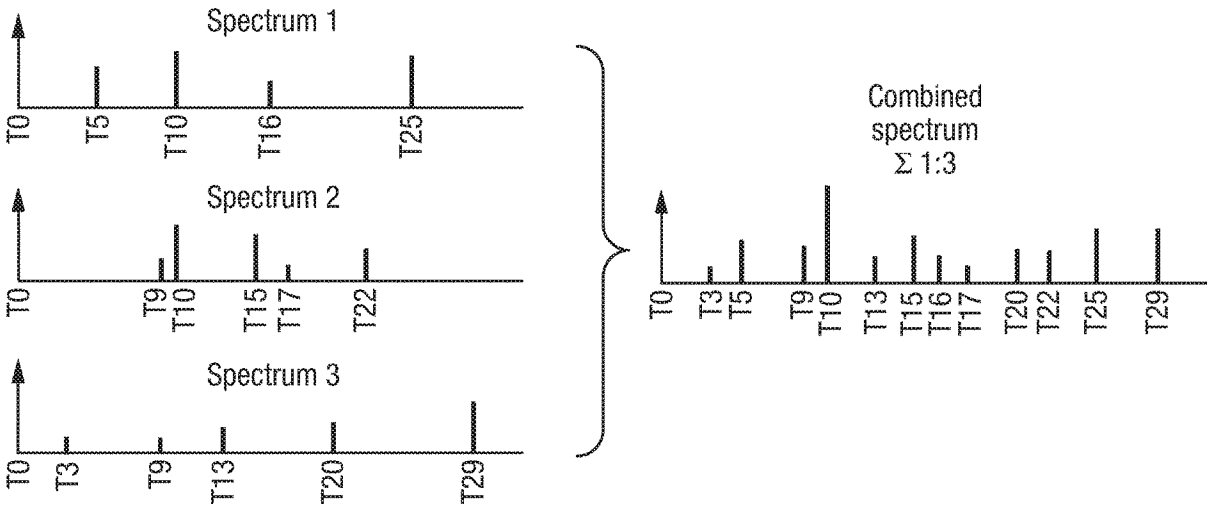
FIG. 3 shows a diagram showing how spectra may be consolidated into a combined spectrum.

The concept is illustrated in the diagram of FIG. 3. The left hand side of FIG. 3 shows spectra for individual pushes S1, S2 and S3. The right hand side of FIG. 3 shows what is achieved in this embodiment i.e. combined and summed spectra from sets S1 to S3 inclusive.

A front end FPGA of the processing module 8 writes out time and intensity pairs to the data collection module 9. It only writes centroided events. The top left hand corner of FIG. 3 is the earliest point in time whilst the bottom right hand corner of FIG. 3 is the latest point in time.

FIG. 4 is a table showing how records are stored in the two memory banks bank 0 and bank 1.

Spectrum 1 has events at times 0, 5, 10, 16 and 25. These events are represented as: S1T0, S1T5, S1T10, S1T16 and S1T25 from an input First In First Out ("FIFO") buffer. Since bank 1 is empty after initialisation, Set 1 is streamed from the input FIFO directly into incremental address locations of memory bank 0. When the input detects the start of a new record (e.g. trigger S2T0) the final bank 0 address (4) is stored in a bank0_end_of_list register, inside the FPGA. Alternatively, an end of list marker may be written to the memory but this can be less efficient. The start of the new record also zeros both memory address pointers and swaps bank 0 from write to read and bank 1 from read to write. The first event is read from bank 0 S1T0 and added to the start event of spectrum 2 S2T0. These summed trigger intensities S2T0+S1T0 are then written to bank 1 at address 0. The FIFO is read to obtain the next value S2T9 and both memory address pointers are incremented. If the time code contained within the read memory is less than the time code in the FIFO, the contents of the reading bank is copied to the other memory and both banks' address pointers are incremented. If the time code contained in the FIFO is less than the time code in the reading bank, the data from the FIFO is copied to memory, and just the write bank's address pointer is incremented. The FIFO will also present its next value. If the time code contained in the FIFO is identical to the time code in the reading memory, the intensity data from the FIFO will be summed with the intensity data from the read memory. The result of the summation appended with any one of the identical time codes, will be written to the memory. Both memory address pointers will be incremented in parallel and a new value simultaneously read from the FIFO.

This process will continue indefinitely until all the data from one memory has been merged in with the new FIFO data. The FPGA internals will know when the end of a list has been reached since the reading banks memory pointer will equal to its end_of_list register. When a new record on the FIFO input is detected the memories will once again swap over.

This process may continue for thousands of cycles, merging new spectra with the previously merged spectra. The time ordering of events will be preserved within the data set.

As soon as end of scan is detected on the input stream, any following data in the FIFO will be for the next scan, so rather than merging the read data with the new data, only the new data is written to memory. The data in the alternate memory now contains complete accumulation of the first scan. This is streamed out to the processor FPGA using the appropriate memory banks pointer. Only when read out has finished, will the second spectrum in the second scan be allowed to be merged in. This is not a problem with instruments which have an interscan delay. If the memory interface is of sufficient bandwidth, the FIFOs should not overflow. The interscan delay should allow the FIFOs in the system to become almost empty.

Accumulation will continue on a scan to scan basis. The readout can be sourced from any bank of memory (it depends on which internal cycle the interscan occurs).

Sequential address burst reads and burst writes can lead to optimal use of the SDRAM bandwidth especially if utilising later SDRAM generations with deeper pre-fetch buffers. For example, one of the downsides of DDR3 over DDR2 is that DDR3 has a much higher latency. DDR4 increases latency further. Performing classic histogramming with RMW into DDR3/4 SDRAM technology may not yield optimal performance. The architecture of the various embodiments can exploit the full benefits of latest SDRAM technologies such as DDR3/4 (i.e. higher bandwidth, lower power, lower cost, and greater time to obsolescence than DDR2).

In carrying out embodiments, time and intensity data will be stored in a data field that contains information about IMS channel and coarse time. For optimal encoding the IMS channel and coarse time can be differentially encoded. Thus, the IMS may be coded as just two bits, for example as follows:

00=No change
01=Increment IMS
10=Reset IMS
11=Indicate scope mode data

This is possible because IMS channels are incremented in time order from the mass spectrometer. There will not be skipped an IMS segment even with empty data since there will be at least one event per IMS i.e. the trigger at time zero with intensity=1. It is generally desirable to retain the sending of the trigger event for embodiments to work effectively. Two bits are used, since when IMS channel is invalid it is sent to scope mode data channel (and it is generally necessary to retain scope mode) and the IMS will reset multiple times within a scan so a way of communicating this is generally desirable. Simple code during time ordered readout can reconstruct the true IMS channel number.

The coarse time too may be differentially encoded. For example, by encoding the time difference from the previous event it is not necessary to store a full 20-bit coarse time field. The front end FPGA may be modified to send dummy time values (i.e. events with intensity=0) should the range of the differential field be exceeded. However, if the coarse time is differentially encoded, the ability to easily identify triggers may be lost. Currently triggers are identified by zero coarse and fine time and an intensity of 1 so they can easily be accumulated for diagnostics and statistics. When using differential time a zero difference would not necessarily indicate a trigger event (especially if merging peaks from two ADC channels in the front end). A better solution is therefore to code trigger and IMS as a 3 bit code, for example as follows:

000=No change (rest of frame contains data point with differential time)
001=Trigger occurred—reset the reconstructed coarse time register
01X=Increment IMS
10X=Reset IMS
110=Indicate scope mode data (non-trigger frame)
111=Trigger frame of Scope mode data Pipelined merge logic takes the encoded input data stream and merges it in with the read stream preserving the inherent time ordering. If the time codes indicate that the input data is earlier in time than the merge stream it will keep reading the input stream and copying it to the write switch stream. If the merge stream's time codes indicate that the events in memory represent earlier time, the memory contents will be copied from one bank to the other. If the time codes are identical in both streams then the intensities in the records will be summed before being streamed out. As the events in the write switch toggle between two inputs (MER_IN and NEW), new differential time codes are calculated (if using ΔT) and inserted into the write stream data. The merge logic can generate the cycle signal and control the memory addressing pointers and EOR (End of Record) registers.

A write switch switches all the data bus lines from the output (MER_OUT) of the merge logic to either BANK 0 data bus or BANK 1 data bus. The switching alternates at the start of a new record.

For non-IMS instruments a trigger may be the start of a record. The record is a list of ion mobility-time-intensity pairs i.e. various embodiments store the ion mobility and time values in memory data instead of the time and ion mobility values being implicit in the memory address. The physical memory addresses will be generated from pointer registers that self-increment the list in memory.

Initially both bank pointers will be 0. The input stream will be read and contents written to bank 0, and a Bank_0_Pointer will increment with each write to bank 0.

When the next record arrives, bank switching of the data bus will occur. Bank 0's pointer will be captured in the bank 0 EOR (End of Record) register before being set to 0 ready for traversing the reads. Bank 0 will now be read and the events will be merged in with the new data from the FIFO. Bank 1's pointer will be incremented with each write to bank 1, whilst bank 0's pointer will only be incremented when a new read from bank 0 is taken (merge dependent) this will continue until bank 0's pointer equals the bank 0 EOR. If values in the FIFO contain a greater time value, these values will continue to be written into bank 1 until the start of the next record is detected at the input stream when the read and write bus switch over again.

The process is repeated for the full scan.

For IMS instruments it is proposed to use the IMS sync (synchronised to a trigger) to demark the individual records and minimise bus turnaround even further. Provided that the number of pushes per IMS (pushes_per_IMS)=1, the inherent time ordering will be preserved. If pushes_per_IMS>1, further downstream accumulation (beyond the data collection function) may be required to combine the portions in the list that have equal IMS.

Alternatively records may be marked with triggers instead of IMS syncs but the merge functionality may have to inspect IMS channels to preserve the strict time ordering. More frequent bus turnarounds may impair IMS performance because it may be necessary to transverse all the points in the IMS list every push period.

Figure 5:
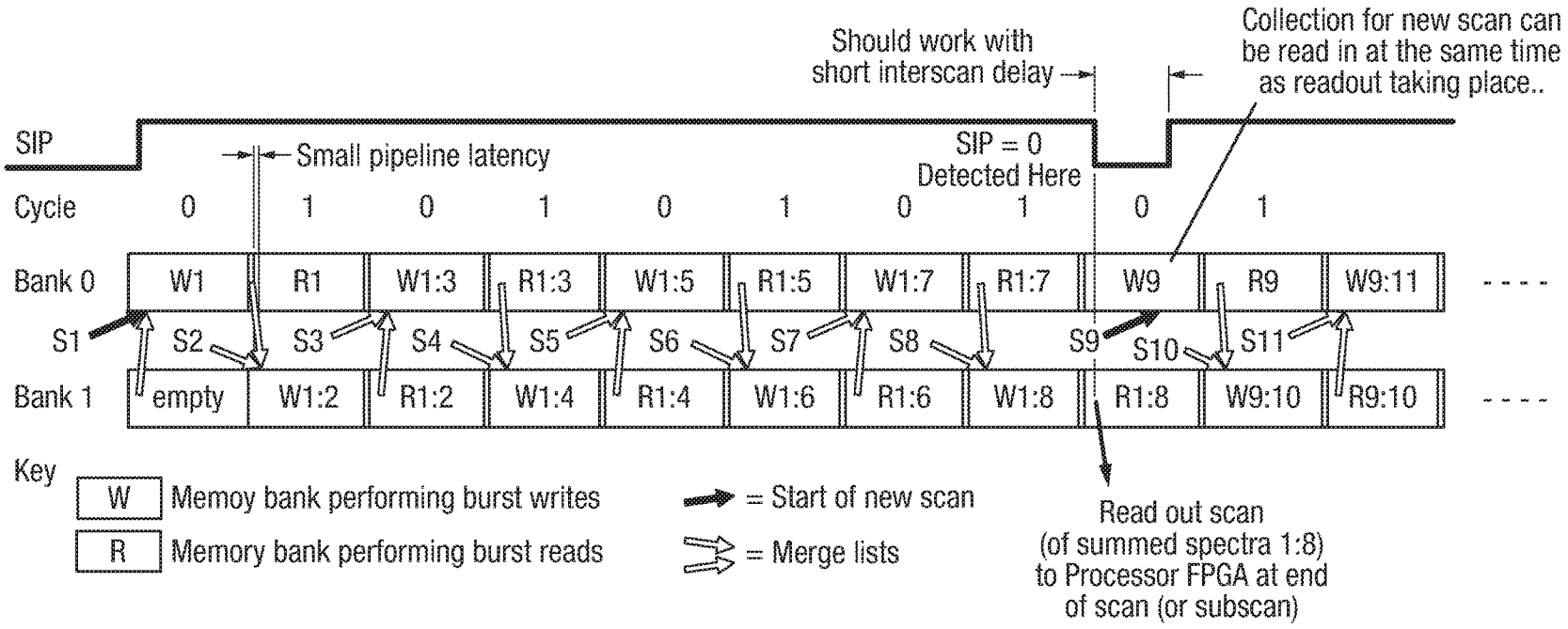
FIG. 5 shows a diagram showing memory bank activity over time.

The typical burst bus activity is shown in FIG. 5. In FIG. 5, the terminology is as follows:

- Sn=Event Set list number n; a Set is a list of time incrementing TI (Time-Intensity) pairs from the front end FPGA
- Rn=Read entire event set n from the buffer in memory; the TI pairs from this read are sent to the pipelined merge block
- Wx:y=Write event set x to y where x and y are event set numbers and y>x in time; x=1 at start of scan x=z at the end of the "scan" (or sub scan).
- Rx:y=Read the merged and accumulated event sets from set x to y.

Figure 6:
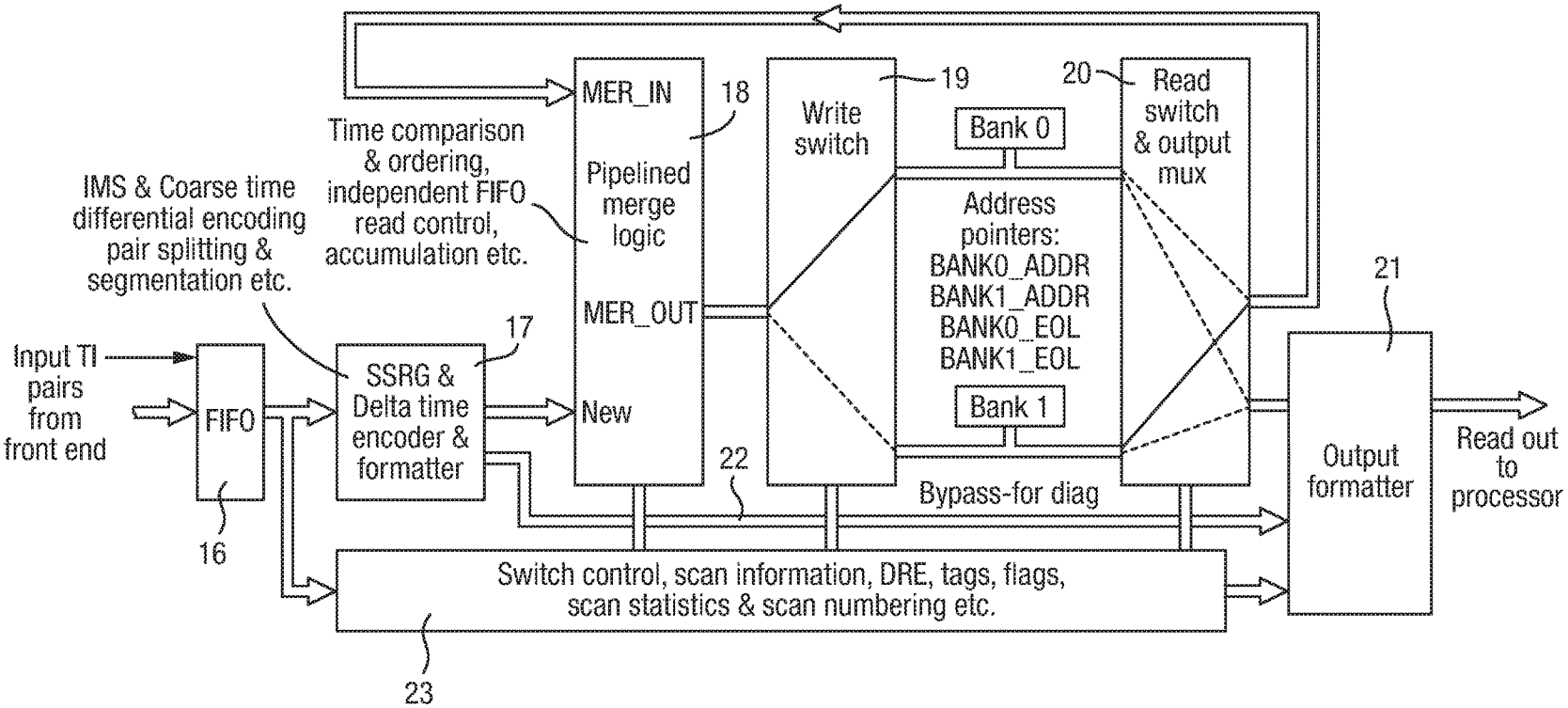
FIG. 6 shows a more detailed diagram of the data collection module of FIG. 2.

The block diagram of the FPGA of the data collection module internals are shown in In FIG. 6. In FIG. 6, a FIFO buffer 16 receives the time and intensity pairs from the processing module 8. The time and intensity pairs are passed to an encoder and formatter 17. This carries out IMS and coarse time differential encoding, pair splitting and segmentation as will be discussed below. A Pipelined Merge Logic module 18 merges the data read out from a memory bank with new data to provide a new merged data stream. This is written to the appropriate memory bank by a write switch 19. The memory banks are accessed by a memory read switch 20 which also incorporates an output multiplexer so that the final merged data stream at the end of a scan can be read out. This is connected to an output formatter 21. There is a bypass 22 for diagnostics, and there is also a path 23 for other data, such as switch control, scan information, dynamic range enhancement (DRE), tags, flags scan statistics, scan numbering and so forth.

Bank switching is done on alternate cycles as indicated by 0/1 cycle count shown at the top of FIG. 5. This cycle count is incremented upon the arrival of a new time ordered data set from the front end. i.e. the arrival of a trigger or synchronised IMS sync as discussed above. The cycle count controls the data bus read/write switching.

The read switch 20 operates in anti-phase to the write switch 19 e.g. if the write switch 19 is writing to bank 0 then the read switch 20 will be reading from bank 1 (as shown by the solid lines inside the switches in FIG. 6).

The read switch 20 connects the data bus from the relevant memory to the MER_IN feedback port of the pipelined merge logic. The read switch 20 also contains another output, this time to the output formatter 21. This data path is only activated upon the scan block detecting the end of scan. It will be sourced by either bank 1 or 0 depending upon which cycle the end of scan signal arrived. FIG. 5 shows SIP (Scan-In-Progress) going low in cycle 0 hence the readout is taken from bank 1. If SIP had gone low in cycle 1 the readout would have been from bank 0. When the read switch 20 is active the feedback bus to the merge logic is forced to all zeros, so that only new events rather than summed events get accumulated for the next scan.

Scan/Tag/DRE info etc. does not need to go into the list in memory—this can be handled in the same way as in known designs (i.e. held in FPGA registers and transferred on SIP). Edge detection of the SIP signal can be sent to the pipeline merge function so that the read switch 20 can be switched in and out of read out at the appropriate times. Scan statistics and scan numbering etc. can be calculated in the scan control logic block as in known data collection. These parameters can be sent to the output formatter 21.

One advantage of storing delta time (and IMS) values together with the intensity information in the list is that the data in memory is very similar to the data payload required to be transmitted to the processor FPGA for compression such as LZRW3. The function of the output formatter 21 is to map any differences in the memory structure to the output frames. For example, the amplitude is a greater resolution due to fractional values (from pair splitting) when stored in memory—the data formatter will dispose of these when transferring to the output—likewise with point error ratio—this will be compressed into a single point error bit. Removing such fields can optimise the output transfer rate. Differential amplitude encoding may also be performed here instead of in the processor FPGA. In some embodiments, the output formatter 21 may revert the data back to intensity pairs for data format compatibility.

As well as formatting the payload of the data stream, the output formatter 21 can interface to the scan information block and insert the relevant frames at the start and end of the readout. The contents can be computed within the FPGA registers—there is no need to store them in SDRAM.

A useful feature for diagnosing system problems when tools such as Chip Scope are not available may be a bypass mode whereby the input steam can almost directly bypass the data collection and input data can be collected by the processor.

Figure 7:
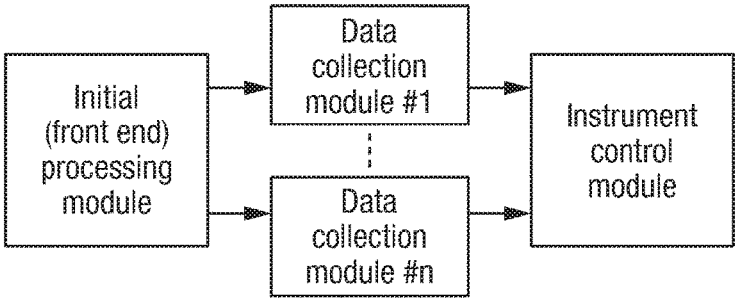
FIG. 7 shows a diagram showing how two data collection modules can be used in parallel.
Figure 8:
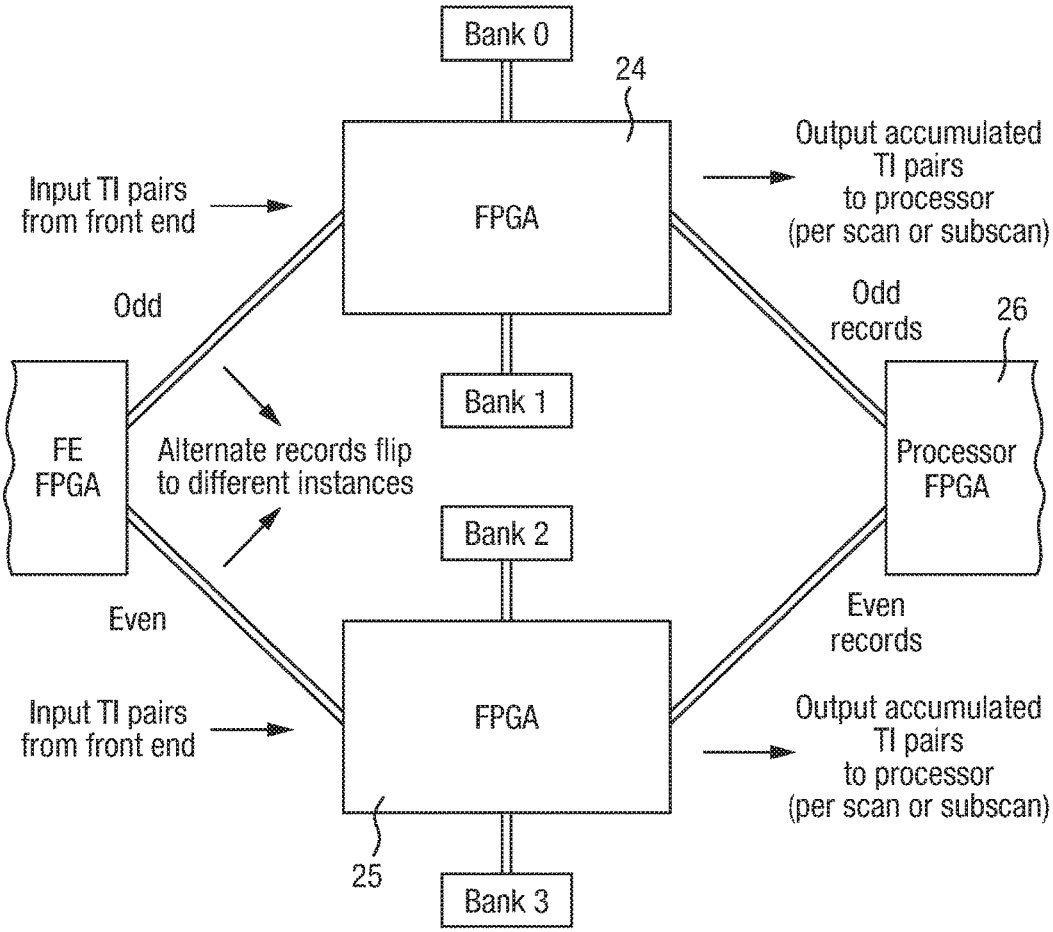
FIG. 8 shows a more detailed diagram showing the arrangement of FIG. 7.

If a single instance of a data collection module cannot handle the required data rate, multiple instances can be instantiated as illustrated in FIGS. 7 and 8. Any number of data collection modules can be used as illustrated in FIG. 7. Two collection modules are shown in FIG. 8, each with its associated FPGA 24 and 25 respectively and each with two memory banks (bank 0 and bank 1; and bank 2 and bank 3 respectively) so that there are four memory banks in total. This will theoretically double the performance of the single instance since now two memory buses are streaming writes, whilst the other two busses are streaming reads. An output processor FPGA 26 can merge the two output streams.

In the dual memory architecture of the embodiments described above, the FIFO can buffer to store input events during readout. The intention is that readout occurs during the interscan time. As instrument scan rates get faster and interscan times decrease, there is the possibility that reading out long lists of accumulated data may take longer than the interscan time. This is not a problem in itself (the input FIFOs buffers would get deeper) provided the overall data rate is not excessive but it does mean that the scan time allocated to merging the next scan is now reduced. Effectively, this increases the number of events/second to be processed in the next scan. One consolation is that at the start of each scan the number of events in the list will be at its lowest (since there is fresh data—no merges performed yet). This may give some extra catch up time to empty the FIFOs with high performance memory architecture. If the input FIFO does not get emptied during the first half of the scan then the FIFO depth will deepen upon every scan and eventually result in data loss.

Figure 9:
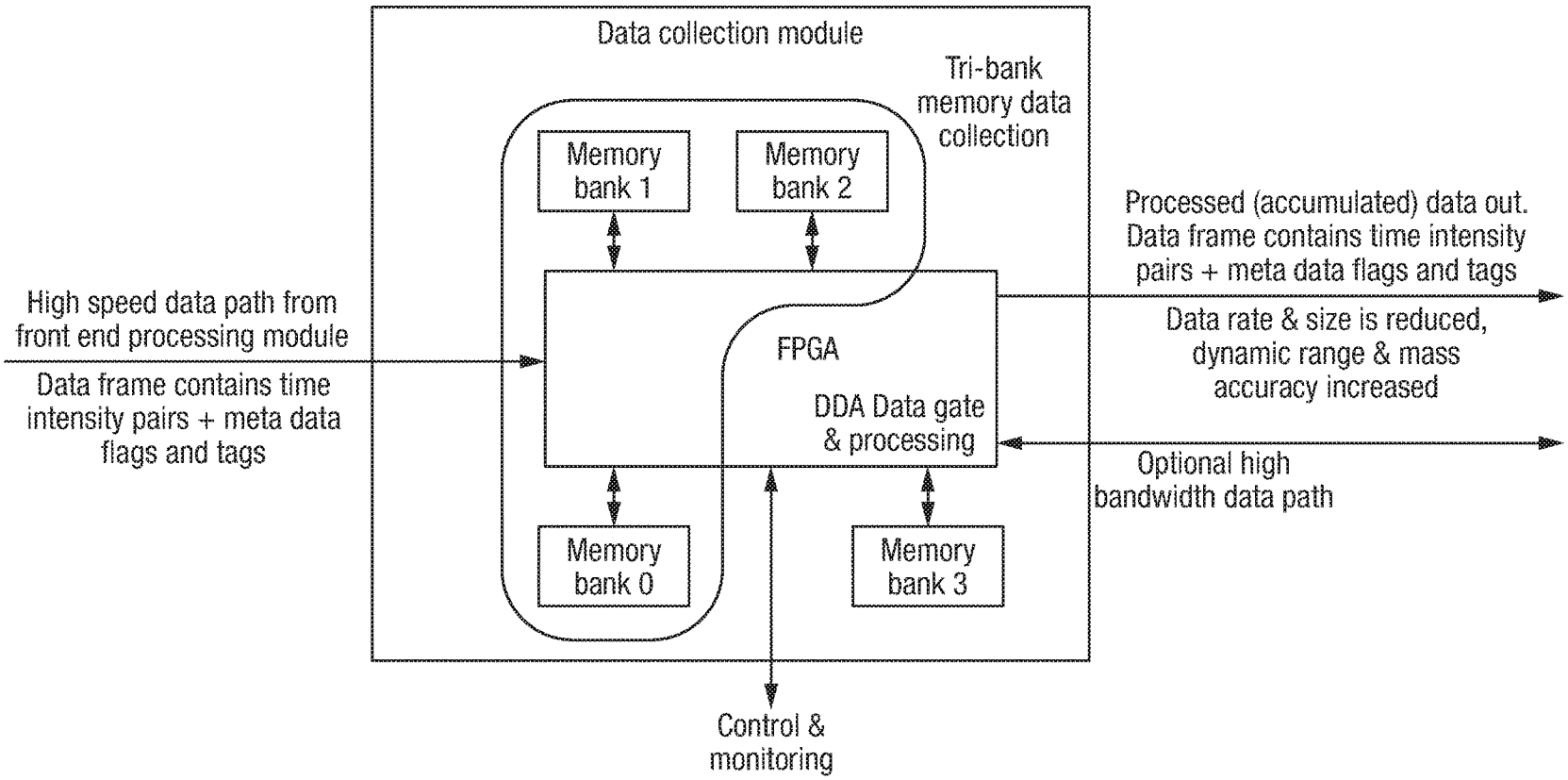
FIG. 9 shows a diagrammatic view of another embodiment of a data collection module.

If the calculated longest readout time (taking into account the memory and communications links bandwidths and processor hold offs) is significantly longer than the interscan time it is possible that this will not eat into the next scan time by allocating one or more additional separate memory banks and controllers, as shown in FIG. 9. This shows three memory banks, bank 0, bank 1 and bank 2 as well as an optional fourth memory bank, bank 3.

Implementation on three memory bank or "tri memory bank" hardware is very similar to the implementation on the two bank data collection hardware i.e. during a scan merging occurs between the input data stream and two memories. The difference is that the merge can use any two of the three available banks. The third bank (whichever number that happens to be at the time) is reserved for the next scan i.e. the place where extended readout may hold off processing in the dual memory case.

For example, assuming that at the start of an acquisition data is being merged between the input and bank 0 and 1. Depending upon when the end of scan occurs, the final accumulated list may be in either bank 0 or 1. If the final list is in bank 0, the next scan will merge between the input and bank 1 and 2. If the final list is in bank 1, the next scan will merge between the input and bank 0 and 2. The new scan can start merging between bank 1 (or 0) and 2 immediately. It does not have to wait for readout of bank 0 (or 1). Readout of bank 0 (or 1) can be performed straight away and at the same time as the next scan is being accumulated. Furthermore, with a three bank memory solution the read out can take as long as required (up to the length of a whole scan+interscan) without limiting the merging performance.

In a tri memory system, merging is done between the input and two memory banks as described in the preceding embodiments, save that the two memory banks can now be any two of the three available memory banks. The memory bank that is not used for merging is used for readout. Determination of which two banks to use depends upon which banks are currently being used for the merge and at what point the end of scan occurs.

Figure 10:
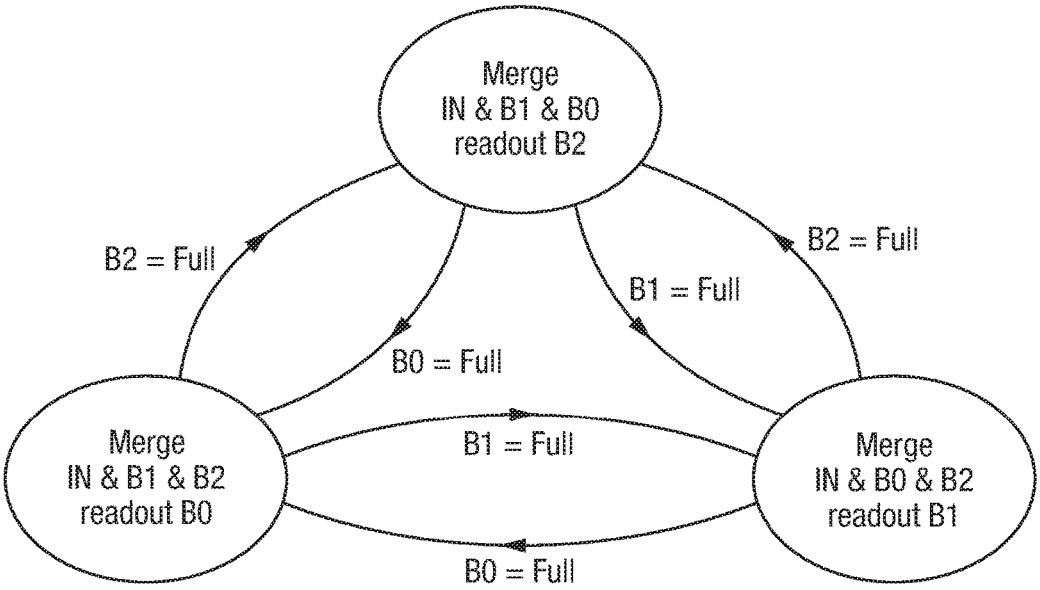
FIG. 10 shows a diagram showing how three memory banks are used in an embodiment.

FIG. 10 shows a state machine for controlling the bank switching in a tri memory system. Null readouts may be supported in case of the first instance after switch on (no readout) or for empty scans (no detected peaks).

For conventional histogramming techniques in Time of Flight mass spectrometry, the input event rate limitation may be determined by the memory RMW rate capability alone, whereas for the architecture proposed in embodiments as described above, the input event rate limitation may be predominantly determined by the points in the list and the maximum rate that the memories can be streamed i.e. the maximum output data rate. Decreasing the output resolution (moving to larger interval or bin widths) will decrease the output event rate. Using the various embodiments, the output event rate equals the memory access rate, so the maximum number of points in the output spectrum will determine the input event rate performance. Thus, reducing the number of populated output bins per spectrum can increase the input event rate capability of the method.

Figure 11:
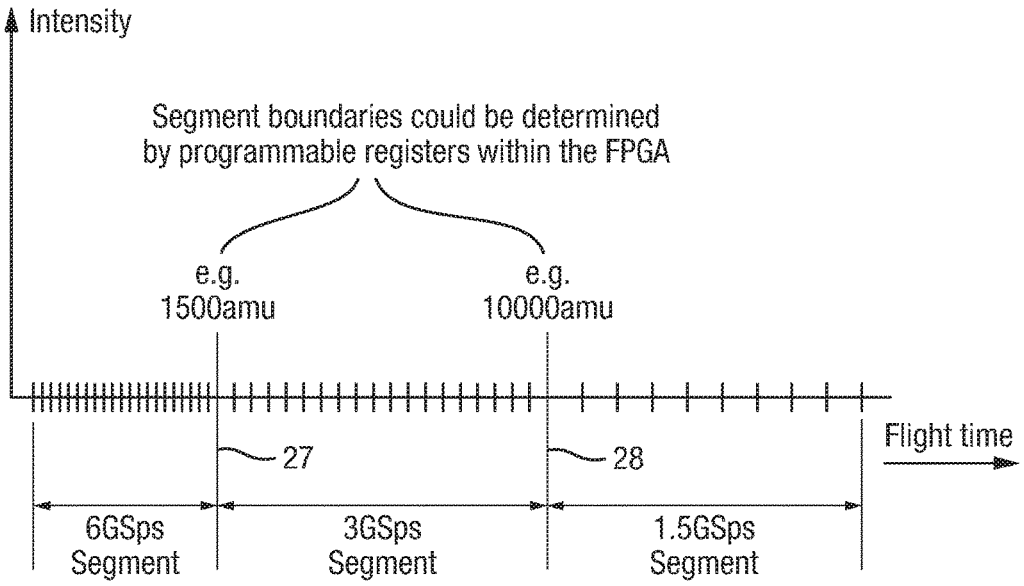
FIG. 11 shows a diagram showing how the resolution can be segmented in some embodiments.

In practice it may be that only the lower mass or mass to charge ratio range (shorter time of flight) of the instrument needs a finer, for example pseudo 6 GSps (Gigasamples per second), resolution grid. So if the spectrum is segmented as shown in the example of FIG. 11, the output spectral density would be reduced, directly leading to increased input event rate capability. Implementing a segmented resolution grid not only increases the input event rate handling capability but can aid downstream transfers, embedded processing, file sizes on disk etc. (fewer points to transfer, process and store).

The segmentation points where the bin width scaling changes resolution may be made programmable by software for different instruments and/or applications on that instrument.

In a simple form there may be two programmable time thresholds e.g. lower mass or mass to charge ratio and higher mass or mass to charge ratio, corresponding to the two vertical lines 27 and 28 in FIG. 11. Segmentation of the grid may be implemented in the input encoding block 17 of FIG. 6. If the coarse time from the input FIFO is less than the lower mass or mass to charge ratio threshold, the pair split may split the intensity to a 6 GSps higher resolution grid. If the time from the front end is between the lower mass or mass to charge ratio and higher mass or mass to charge ratio thresholds, the pair split will split the intensity to a 3 GSps mid mass or mass to charge ratio mid resolution grid. Once this operation has been done on the input stream, the maximum number of points in memory required for each lower resolution segment will be halved. If the time value exceeds the higher mass or mass to charge ratio threshold the pair split may split to a 1.5 GSps higher mass or mass to charge ratio lower resolution grid. Doubling the bin width again (e.g. to 1.5 GSps for the higher mass or mass to charge ratio segment) means that the number of points required is one quarter of the possible number of points of the original 6 GSps resolution. The data set will intentionally have missing time codes in these segments, but since the method in accordance with embodiments arranges the records in a list in memory, the memory depth is minimal. The above frequencies (i.e. 1.5 GSps, 3 GSps and 6 GSps) are provided merely as examples. In practice, the frequencies used may comprise any frequencies that can be derived from the, e.g. ADC, sample rate. The bin widths may also be adjusted accordingly.

More segments (and segment boundary registers) may be added if required. Alternatively, a look-up table approach may be implemented where different mass or mass to charge ratio ranges can be set to different resolutions. The resolution does not necessarily have to step monotonically through the spectrum. The lookup table may be set by software for particular experiments, for example if there are three mass or mass to charge ratio ranges of interest and a user wants to know roughly what is in the rest of the spectrum but is not concerned about higher resolution in these areas. Software would then program the three areas of interest to higher resolution and the other areas to lower resolution. The principle may be extended to also step the resolution for different IMS channels. This may considerably optimise input and output event rate performance as well as file size for the user.

Segmentation can be made completely transparent to software. Transparency is eased by the new architecture in accordance with embodiments. Various embodiments do not use memory addresses as time values but store time (or ΔT) alongside intensities in the list. The Time (or ΔT's) in the list can be kept at the chosen highest segment resolution for the system. The dynamic range for T does not change with the segments. All that happens is that for the spectra occurring within the next lowest resolution segment, no odd time codes from the higher segment occur. This can be explained with reference to Table 1 below.

TABLE 1

| Bin Width | Notes | Valid time codes that will occur in the list |
|---|---|---|
| 42 ps | Highest Resolution Pseudo 24GSps - may be used as the base resolution even if only 1 × 3GSps ADC is used. | 0, 1, 2, 3, 4, 5, 6, 7, 8 . . . up to ΔT max |
| 83 ps | Pseudo 12GSps | 0, 2, 4, 6, 8, 10, 12 . . . up to ΔT max |
| 167 ps | Real 6GSps ADC (e.g. where 2 interleaved 3GSps ADCs are used) or Pseudo 6GSps (e.g. where 1 × 3GSps ADC is used). | 0, 4, 8, 12, 16, 20 . . . up to ΔT max |
| 333 ps | Down sampled 6GSps ADC or 1 × 3GSps ADC used (e.g. for a lower cost solution) | 0, 8, 16, 24, 32, 40 . . . up to ΔT max |
| 667 ps | Down sampled from above | 0, 16, 32, 48, 64 . . . up to ΔT max |
| 1.3 ns | Down sampled from above | 0, 32, 64, 96, 128, 160 . . . up to ΔT max |
| 2.7 ns | Down sampled from above Lowest Resolution | 0, 64, 128, 192, 256, 320 . . . up to ΔT max |
| Programmable Segmentation Boundaries may only be allowed to be programmed with a step size equivalent to the lowest resolution available in the hardware. | | |

Valid Time Codes and Permitted Segment Boundaries

Deterministic missing time codes may be subjected to data compression such as LZWR3 within the processor FPGA.

The doublet resolving capabilities of the acquisition system will be reduced in the segments programmed for wider bin width, increasing the probability of coalescence in these segments. The segmentation boundaries may therefore be programmed in line with the orthogonal acceleration Time of Flight instrument's resolving capability over mass or mass to charge ratio (or users experiment requirements). Different instrument geometries will have different resolving capabilities as a function of mass or mass to charge ratio.

If the segmentation boundaries are programmed in line with the resolving capability of the instrument then there should be no problems with mass or mass to charge ratio accuracy or intensity anomalies at the programmable segmentation boundaries. Thus the grid segmentation process can be considered as seamless.

To preserve mass or mass to charge ratio accuracy between the different time grids the input encoder can pair split the single input event to the appropriate output (and accumulation) resolution time grid determined by the current input time and look-up table values. In this case, each segment may contain an even number of equally spaced bins to simplify the pair split calculation at the boundary points.

If using pair splitting in the data collection architecture, there may be two adjacent intensities in the grid that are being written to at any one time. As far as data rates and memory sizing goes it is possible to take advantage of this fact in the hardware layout. An optimisation for memory, for example, may be to store the pair of intensities together in a single memory address.

For example, the record for a single event write to SDRAM may be: ΔIMS, ΔCoarseTime, PointErrRatio, IntensityLow and IntensityHigh.

Using embodiments of the method together with a segmented resolution grid can provide better or optimal storage. If the segmented resolution grid is implemented using classic address based histogramming the programmable segment registers may only be set in powers of 2 and output decoding of the memory address would be required. So the method according to various embodiments aids the implementation of the segmented resolution gird and segmented resolution grid reduces the memory size and thus increases event rate performance of method according to various embodiments. Thus they are mutually beneficial.

A feature of the architecture according to various embodiments is that the whole data set is traversed for every input set. This is a disadvantage compared to address lookup histogramming in terms of the sheer number of memory accesses required. However, the fact that the complete spectrum is continuously streamed through the FPGA has advantages for Data Directed Acquisition (DDA). Thus, FPGA registers can "see" every point in the spectrum during processing. Whilst the FPGA has this data, there may be no timing overhead by copying it to two (or more) places at once, for example to either an additional memory, or dual ported to a processor or communications port.

Figure 12:
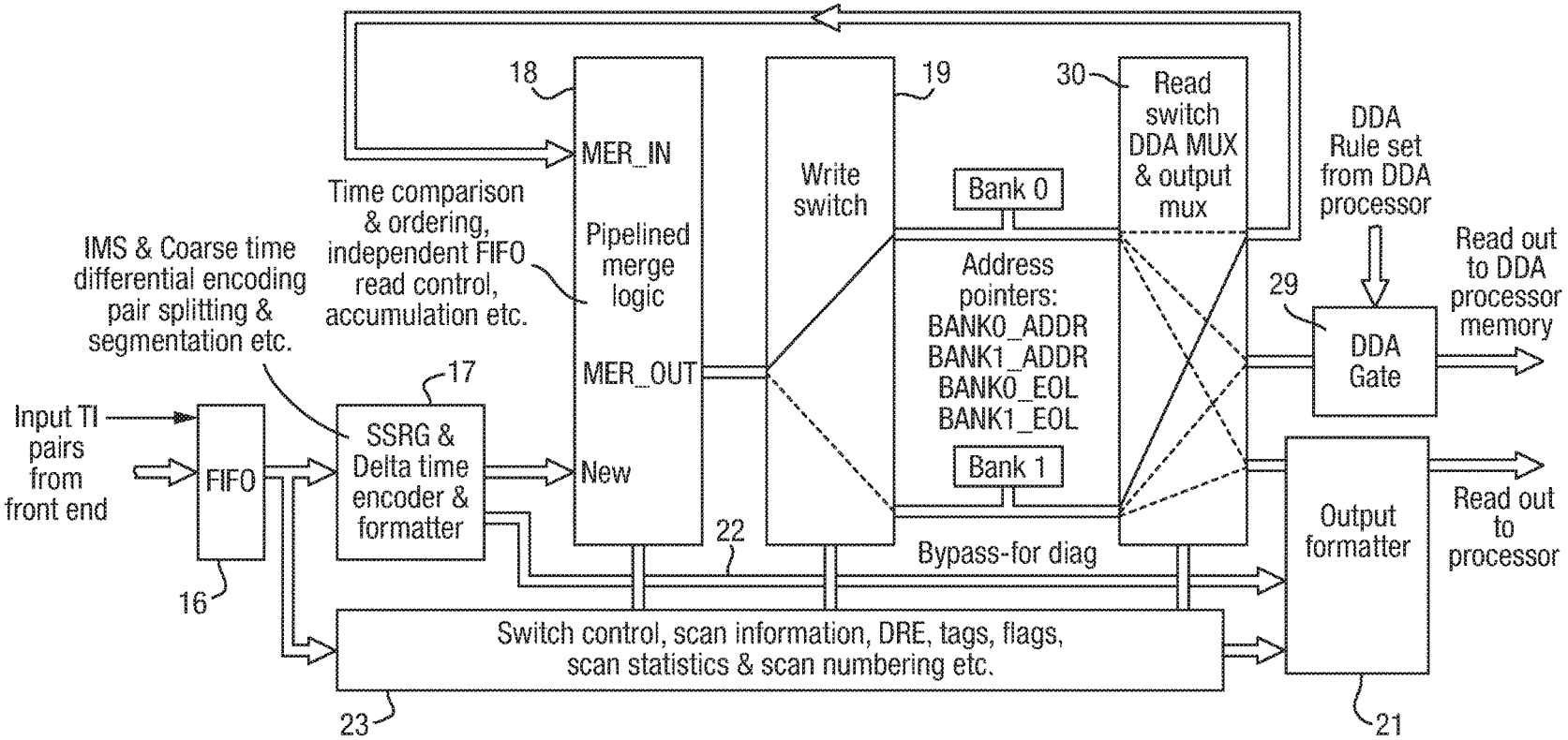
FIG. 12 shows a diagram showing a data collection module incorporating a DDA gate.

As well as writing to the memory banks of the system, the same data may be written to a DDA Data Gate 29 as shown in FIG. 12. The DDA data gate 29 will be pre-programmed with a DDA Rule Set programmed via software. The rule set can be tailored to requirements, but the following scenarios are envisaged: (i) sending the spectrum once every N (where N is programmable) iterations (e.g. whilst the scan is building up—there is no need to wait until the end of scan) to either an additional memory (DDA memory) or a communications port such as PCIe or SpaceWire; (ii) the DDA Data Gate may curtail the spectrum sent to the DDA decision software to certain time windows; (iii) the DDA Data Gate may just transmit peaks that exceed certain amplitudes to the DDA decision software; or (iv) any combination of the above.

Any DDA processor can then make directed decisions during the same scan instead of waiting for whole scan to be transferred and then re analysed by software. The DDA processor itself may be any of the following: (i) an embedded soft core processor inside the FPGA; (ii) an external Microcontroller (e.g. ARM); or (iii) an Embedded PC or COM express module. If this is the case the data collection may stream curtailed spectra directly into EPC memory over a PCIe link (or other communication protocol).

FIG. 12 shows the same proposed architecture as in FIG. 6 but now extended for DDA. There is a DDA Gate 29 which receives a DDA Rule Set from a DDA processor and reads out to the DDA processor. The Read Switch 30 also incorporates a DDA multiplexer.

Figure 13:
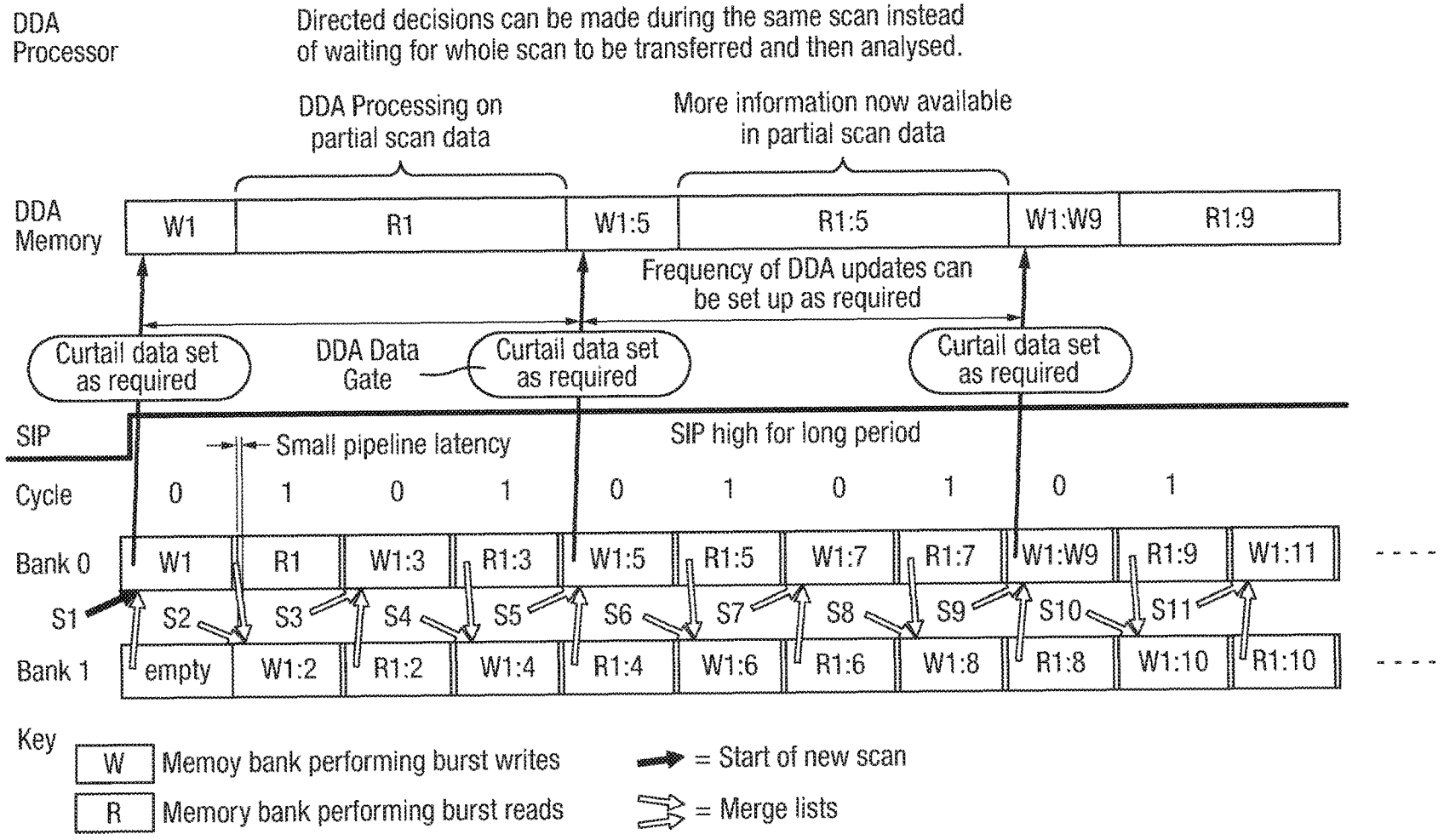
FIG. 13 shows a diagram showing how memory banks may be used in conjunction with a DDA system.

FIG. 13 shows the bus timing with DDA. The frequency of DDA updates can be set as required, as can the manner in which if DDA data is curtailed, if that is done.

The method of various embodiments can eliminate or reduce continual bus turnaround due to RMW cycles. Bus turnaround may now only occur with each new data set (IMS sync or pusher trigger). Furthermore, pointer addressing can mean that reads and writes have sequential address access—minimising page misses. Other advantages of various embodiments can include the Number of Points calculation (for scan statistics) may be a natural by-product of the method and may be easily computed from the end of list pointer and the memory efficiency may increase as the number of events in the list grows.

The various embodiments can also have the advantage that there is no need for usage RAMs within the FPGA. Memory utilisation may be inherently optimised to spectral density—the more events per output record, the deeper the memory.

The various embodiments can benefit from faster readout speeds and there may be no need to clear memory on read out. Simply overwrite the lists and rely on trigger (start of list) and end of list pointers.

The various embodiments can exploit the burst transfer performance of SDRAMs (especially when migrating to DDR3/4 with higher latencies).

The various embodiments can also be good for fast (or sub) scanning and can benefit from low latency.

Although the present invention has been described with reference to various embodiments, it will be understood by those skilled in the art that various changes in form and detail may be made without departing from the scope of the invention as set forth in the accompanying claims.

The invention claimed is:

1. A method of Time of Flight mass spectrometry comprising:

generating ions using an ion source;

separating the ions using a Time of Flight separation device;

detecting the ions when they arrive at an ion detector;

receiving, by a data acquisition system, data from the ion detector, the data acquisition system including a processing module and a data collection module;

during a first scan, generating, by the processing module, a stream of data containing a plurality of sets of data, each set of data including a plurality of data pairs of: (i) a time of flight related parameter; and (ii) an intensity related parameter, in respect of a respective transient; and passing the stream of data from the processing module to the data collection module;

wherein:

the data collection module includes a plurality of memory banks;

a first data set of the stream of data is written into a first memory bank of said plurality of memory banks;

after completion of writing the first data set into said first memory bank, the data in said first memory bank is read out and merged with the data of a second data set of the stream of data to create a merged data set and wherein the merged data set is written into a second memory bank of said plurality of memory banks;

after completion of writing the merged data set into said second memory bank, the data in said second memory bank is read out and merged with the data of a third data set of the stream of data to create a latest merged data set and wherein the latest merged data set is written into a memory bank of said plurality of memory banks, other than the second memory bank; and at the end of the first scan, the data in the memory bank containing the latest merged data set is read out and a merged data stream containing that latest merged data set is outputted from the data collection module;

wherein there is a predetermined series of consecutive intervals to contain time of flight related parameter values; and in merging the data from a memory bank with a data set in the stream of data to create a merged data set, if a data pair in the data from the memory bank has a time of flight related parameter value within the same interval in said predetermined series as a time of flight related parameter value of a data pair in the data set in the stream of data, a single data pair is created in the merged data set; and outputting a spectrum corresponding to the merged data set.

2. A method as claimed in claim 1, wherein where data in a memory bank is read out and merged with data in a data set in the stream of data, the data in the memory bank is read out and histogrammed with the data in the data set in the stream of data.

3. A method as claimed in claim 1, wherein where data in a memory bank is read out and merged with data in a data set in the stream of data, if a data pair in the data from the memory bank has a time of flight related parameter value within the same interval in said predetermined series as a time of flight related parameter value of a data pair in the data set in the stream of data, the single data pair which is created in the merged data set has an intensity value which is equal to the sum of: (i) the intensity value of the data pair in the data from the memory bank; and (ii) the intensity value of the data pair in the data set in the stream of data.

4. A method as claimed in claim 1, wherein where data in a memory bank is read out and merged with data in a data set in the stream of data, if a data pair in the data from the memory bank has a time of flight related parameter value within the same interval in said predetermined series as a time of flight related parameter value of a data pair in the data set in the stream of data, the single data pair which is created in the merged data set has a time of flight related parameter value which is equal to the average of: (i) the time of flight related parameter value of the data pair in the data from the memory bank; and (ii) the time of flight related parameter value of the data pair in the data set in the stream of data.

5. A method as claimed in claim 1, wherein the plurality of memory banks consists of two memory banks which alternate between being in read mode and write mode so that when one data bank is in write mode and data is being written into that data bank, the other data bank is in read mode and data is being read from that other data bank.

6. A method as claimed in claim 1, wherein the plurality of memory banks includes three memory banks, and at any given time whilst the stream of data is being received during the first scan, a merge operation is carried out using two of the memory banks and the stream of data so that one of said two memory banks is in read mode and data is read out of that one memory bank and merged with a data set from the stream of data to create a merged data set and the other of said two memory banks is in write mode and the merged data set is written into that other memory bank; and when at the end of the first scan the latest merged data is read out of one of said two memory banks, the remaining two of the three memory banks and the stream of data are used in a merge operation during a second scan.

7. A method as claimed in claim 1, wherein data in the sets of data in the data stream, and data in each merged data set, is ordered in time.

8. A method as claimed in claim 1, wherein the intervals or time values are mapped to memory addresses.

9. A method as claimed in claim 1, wherein in the predetermined series of consecutive intervals to contain time of flight related parameter values, the intervals are not equal.

10. A method as claimed in claim 9, wherein there is a first segment of intervals each of which extends over a first, relatively narrower, band of values and a second set of intervals each of which extends over a second, relatively wider, band of values.

11. A method as claimed in claim 10, wherein the first segment of intervals is for values of time of flight parameter values corresponding to masses or mass to charge ratios below a predetermined limit and the second segment of intervals is for values of time of flight parameter values corresponding to masses or mass to charge ratios at or above said predetermined limit.

12. A method as claimed in claim 1, wherein acquired data is analysed during a scan by way of passing data to a data gate at the same time as it is being written to a memory bank.

13. A Time of Flight mass spectrometer comprising:

an ion source configured to generate ions;

a Time of Flight separation device configured to separate said ions;

an ion detector configured to detect the arrival of said ions at said detector; and an acquisition system comprising:

a device arranged and adapted to receive data from the ion detector;

a processing module; and a data collection module comprising a plurality of memory banks;

wherein during a first scan said processing module is arranged and adapted:

(i) to generate a stream of data containing a plurality of sets of data, each set of data including a plurality of data pairs of: (a) a time of flight related parameter; and (b) an intensity related parameter, in respect of a respective transient; and (ii) to pass the stream of data from the processing module to the data collection module;

wherein a first data set of the stream of data is written into a first memory bank of said plurality of memory bands;

wherein after completion of writing the first data set into said first memory bank, the data in said first memory bank is read out and merged with the data of a second data set of the stream of data to create a merged data set and wherein the merged data set is written into a second memory bank of said plurality of memory banks;

wherein after completion of writing the merged data set into said second memory bank, the data in said second memory bank is read out and merged with the data of a third data set of the stream of data to create a latest merged data set and the latest merged data set is written into a memory bank of said plurality of memory banks, other than the second memory bank;

wherein at the end of the first scan, the data in the memory bank containing the latest merged data set is read out and a merged data stream containing that latest merged data set is outputted from the data collection module; wherein there is a predetermined series of consecutive intervals to contain time of flight related parameter values; and in merging the data from a memory bank with a data set in the stream of data to create a merged data set, if a data pair in the data from the memory bank has a time of flight related parameter value within the same interval in said predetermined series as a time of flight related parameter value of a data pair in the data set in the stream of data, a single data pair is created in the merged data se; and wherein the data acquisition system is configured to output a spectrum corresponding to the merged data set.

* * * * *